US007823765B2

(12) United States Patent
Weimer

(10) Patent No.: US 7,823,765 B2
(45) Date of Patent: Nov. 2, 2010

(54) STACKABLE SHIPPING AND DISPLAY BOX

(75) Inventor: Charles P Weimer, Danielson, CT (US)

(73) Assignee: International Paper, Memphis, TN (US)

( * ) Notice: Subject to any disclaimer, the term of this patent is extended or adjusted under 35 U.S.C. 154(b) by 0 days.

(21) Appl. No.: 11/906,747

(22) Filed: Oct. 3, 2007

(65) Prior Publication Data

US 2008/0196361 A1 Aug. 21, 2008

Related U.S. Application Data

(63) Continuation of application No. 10/799,967, filed on Mar. 12, 2004, now Pat. No. 7,293,694.

(51) Int. Cl.
*B65D 25/04* (2006.01)
*B65D 5/28* (2006.01)

(52) U.S. Cl. ..... 229/120.12; 229/120.18; 229/120.35; 229/191; 229/918

(58) Field of Classification Search ..... 229/120.12, 229/120.15, 120.18, 120.35, 162.6, 164, 229/191, 918; 206/427
See application file for complete search history.

(56) References Cited

U.S. PATENT DOCUMENTS

| | | | |
|---|---|---|---|
| 1,700,432 | A | 1/1929 | Cahill |
| 1,875,497 | A | 9/1932 | Richardson et al. |
| 2,074,090 | A | 3/1937 | Loth |
| 2,114,052 | A | 4/1938 | Kincard, Jr. |
| 2,299,812 | A | 10/1942 | Ferguson |
| 2,643,811 | A | 6/1953 | Bolding |
| 2,800,224 | A | 7/1957 | Walter et al. |
| 2,885,137 | A | 5/1959 | Guyer |
| 2,955,707 | A | 10/1960 | Foote |
| 3,338,402 | A | 8/1967 | Becker et al. |
| 3,756,496 | A | 9/1973 | Oostdik |
| 3,857,934 | A | 12/1974 | Bernstein et al. |
| 4,056,223 | A | 11/1977 | Williams |
| 4,068,796 | A | 1/1978 | Kullman, Jr. |

(Continued)

FOREIGN PATENT DOCUMENTS

| | | |
|---|---|---|
| DE | 3729455 | 3/1989 |

(Continued)

*Primary Examiner*—Gary E Elkins
(74) *Attorney, Agent, or Firm*—Thomas W. Ryan, III; Thomas W. Barnes, III

(57) ABSTRACT

An elongate, rectangular box (12, 14, 40, 60, 70, 90, 100) and method for packaging containers (C), wherein the box can be cross-stacked for stable stacking of the boxes, and optimizes utilization of pallet space. Containers (C) are placed in the box in nested, offset relationship in a parallelogram shaped arrangement, and in one embodiment interior corner panels (20, 21) extend angularly across two diagonally opposite corners of the box, defining an interior box shape closely conforming to the parallelogram-shaped arrangement of the containers. The corner panels may be cut from the side walls (18, 19) and folded inwardly and secured at a free edge (28) to an adjacent end wall (16, 17), defining openings (22, 23) in the side wall through which the containers are visible. Side wall segments (24, 25, 26) at the bottom and sides of the opening, in cooperation with the corner panels, retain the containers in place in the box. The box is especially suited for packaging four one-gallon containers.

4 Claims, 12 Drawing Sheets

U.S. PATENT DOCUMENTS

| | | | | |
|---|---|---|---|---|
| 4,102,525 | A | 7/1978 | Albano | |
| 4,155,451 | A | 5/1979 | Miller | |
| 4,272,008 | A | 6/1981 | Wozniacki | |
| 4,601,390 | A | 7/1986 | Rosenthal et al. | |
| 4,607,750 | A | 8/1986 | Valenti | |
| 4,747,485 | A | 5/1988 | Chaussadas | |
| 4,796,754 | A | 1/1989 | Chaussadas et al. | |
| 4,850,527 | A | 7/1989 | Church et al. | |
| 4,871,067 | A | 10/1989 | Valenti | |
| 4,913,339 | A | 4/1990 | Elder | |
| 4,974,773 | A | 12/1990 | Alezander et al. | |
| 5,333,777 | A | 8/1994 | Roth | |
| 5,372,299 | A | 12/1994 | Edgerton, Jr. et al. | |
| 5,452,848 | A | 9/1995 | Mur Gimeno | |
| 5,487,504 | A | 1/1996 | Baird | |
| 5,562,227 | A | 10/1996 | Takezawa et al. | |
| 5,755,377 | A | 5/1998 | Durand | |
| 5,967,406 | A | 10/1999 | Moorman | |
| 6,047,884 | A | 4/2000 | Smith et al. | |
| 6,598,785 | B2 | 7/2003 | Quaintance | |
| 7,293,694 | B2 * | 11/2007 | Weimer, Jr. | 229/120.12 |
| 2002/0083671 | A1 | 7/2002 | Clausen et al. | |
| 2002/0100246 | A1 | 8/2002 | Williamson et al. | |
| 2003/0037502 | A1 | 2/2003 | Bruce et al. | |
| 2003/0132425 | A1 | 7/2003 | Curzon et al. | |
| 2003/0156974 | A1 | 8/2003 | Haas et al. | |
| 2003/0170317 | A1 | 9/2003 | Curzon et al. | |

FOREIGN PATENT DOCUMENTS

| | | |
|---|---|---|
| DE | 4217111 | 11/1993 |
| DE | 4336021 | 4/1995 |
| EP | 1352846 | 10/2003 |
| GB | 525072 | 8/1940 |
| GB | 1243716 | 8/1971 |
| NL | 94977 | 8/1960 |
| WO | WO 2005/090171 | 9/2005 |

* cited by examiner

STACKABLE SHIPPING AND DISPLAY BOX

TECHNICAL FIELD

This invention relates to packaging, and more particularly to a stackable shipping and display box.

BACKGROUND ART

Many products are shipped in cartons or boxes that enable the product to be displayed in the shipping box at the point of sale. These types of boxes are particularly suitable for products sold in club stores, where many products, e.g., juices, typically are packaged in one-gallon containers. Conventional boxes for handling one-gallon containers usually comprise full depth closed RSC's, although partial depth boxes or trays are sometimes used. A divider that extends between the containers normally is used in the partial depth trays to provide adequate strength. Further, conventional boxes for holding one-gallon containers are commonly designed for holding six containers, although some packages, such as those shown in FIGS. 1 and 2, are designed for holding four containers, primarily due to weight concerns. These conventional boxes are square in plan view, with the one-gallon containers orthogonally oriented in side-by-side relationship to one another.

To facilitate handling, it is common practice to stack several layers of filled boxes on a pallet, and sometimes to stack two or more pallets high. Conventional square boxes are often column stacked, and typically require internal or external support to eliminate or reduce load on the bottles. Column stacking of the boxes is inherently unstable, and layer sheets, or slip sheets, may be employed between adjacent layers of boxes to improve the stability of the stacked boxes.

Moreover, the pallets used typically have dimensions of 48×40 inches, and the square boxes do not utilize the pallet space well, i.e., a plurality of the boxes placed in a layer either do not occupy the entire pallet space, or they overhang the pallet, depending upon how the boxes are oriented and how many are placed in a layer on the pallet. Conventional square boxes do not permit any arrangement of the boxes on a pallet that will result in the footprint of the area occupied by the boxes being substantially equal to the shape and area of the pallet. When conventional square boxes holding four one-gallon containers are placed on a conventional 48×40 inch pallet, often only nine boxes, or thirty-six one-gallon containers, can be accommodated in each layer of boxes without overhanging the edges of the pallet, depending upon the bottle diameter and/or footprint.

Accordingly, there is need for a box for shipping and displaying product, wherein the box, when filled with containers of product, has a maximum desired weight and is configured to enable stable stacking of filled boxes, pallet space is optimally utilized, and no load is produced on the product containers, all without requiring the use of separate layer sheets, or separate internal or external reinforcements.

DISCLOSURE OF THE INVENTION

The present invention comprises a box for shipping and displaying product, wherein the box is configured so that filled boxes can be stacked in stable, interlocked relationship, pallet space is optimally utilized, and the product containers are not subjected to load when filled boxes are stacked on top of one another.

To accomplish the foregoing, the box of the invention is rectangular, i.e., has a greater length than width, and containers of product are placed in the box in diagonally offset side-by-side relationship to one another. The diagonally offset placement of the containers results in interior spaces at two diagonally opposite corners of the box, and angled corner panels extend into these spaces to contact the containers to help retain them in the box and to provide stacking support and prevent vertical loads on the containers.

The rectangular shape of the boxes enables boxes in adjacent layers to be cross-stacked and interlocked for stable stacking. Boxes incorporating the invention can be stably stacked two or more pallets high and without imposing a vertical load on the containers.

Although the boxes could be configured to hold different numbers and sizes of containers and still incorporate the features of the invention, in the particular embodiments illustrated and described herein they are sized to hold four one-gallon containers. These boxes can be placed on a conventional 48×40 inch pallet so that the footprint of the area occupied by a layer of boxes is substantially the same as the area of the pallet surface. With the invention, eleven boxes holding forty-four containers can be placed in a layer on a 48×40 inch pallet, although it should be understood that these numbers can vary, depending upon the bottle diameter and footprint.

Additionally, empty containers, e.g., bottles, can be inverted and placed upside down in the box by the bottle manufacturer for shipment to a facility for filling the bottles. The shape of the box, including the angled corner panels, securely holds the inverted empty bottles in place even when some of the side walls have a reduced height to define openings through which the bottles are visible.

Further, the box of the invention, including the angled corner panels, can be made from a single unitary blank of corrugated board, and when loaded with four one-gallon containers of juice, for example, has a case weight less than 40 pounds. In an alternate embodiment, the angled corner panels can be formed from separate pieces inserted into the box.

The box of the invention is equally suitable for use with containers having a round cross-section or a non-round cross section, e.g., square.

BRIEF DESCRIPTION OF THE DRAWINGS

The foregoing, as well as other objects and advantages of the invention, will become apparent from the following detailed description taken in conjunction with the accompanying drawings, wherein like reference characters designate like parts throughout the several views, and wherein.

DESCRIPTION OF THE PREFERRED EMBODIMENTS

Figure 1:
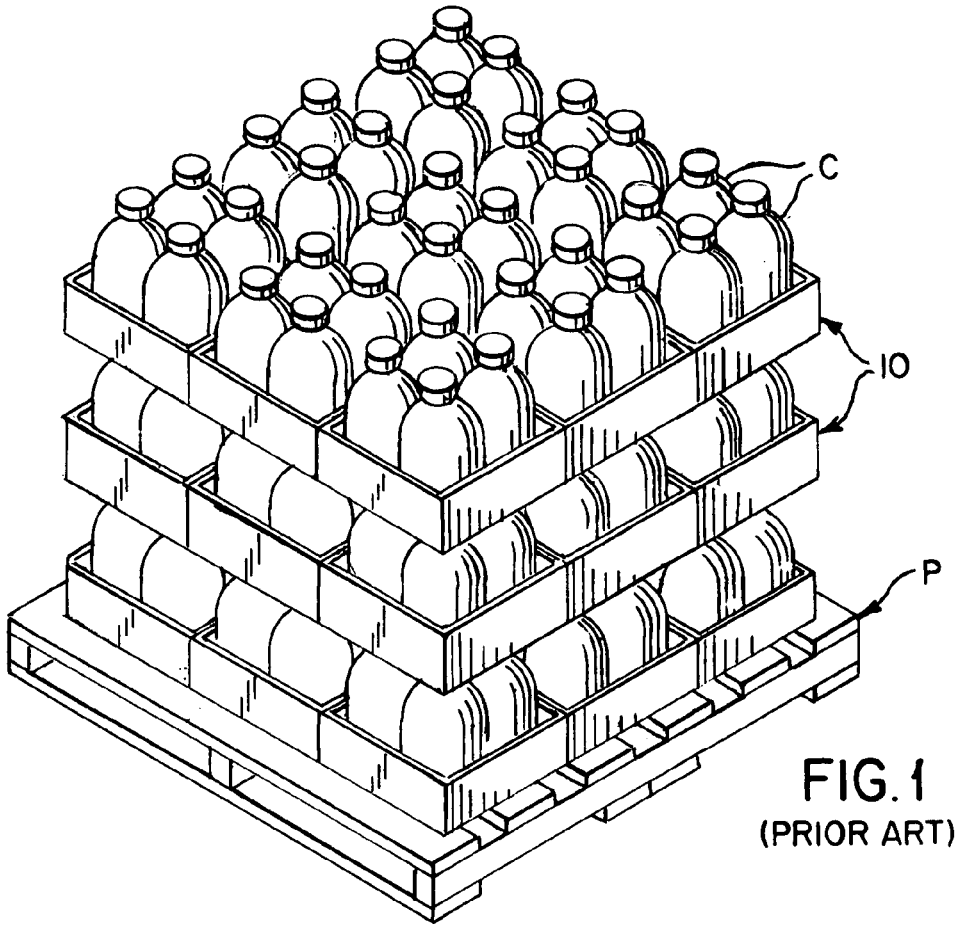
FIG. 1 (PRIOR ART)
FIG. 1 is a top perspective view of conventional partial depth square boxes or trays filled with four containers placed side-by-side in orthogonal relationship relative to one another and column-stacked on a pallet.
Figure 2:
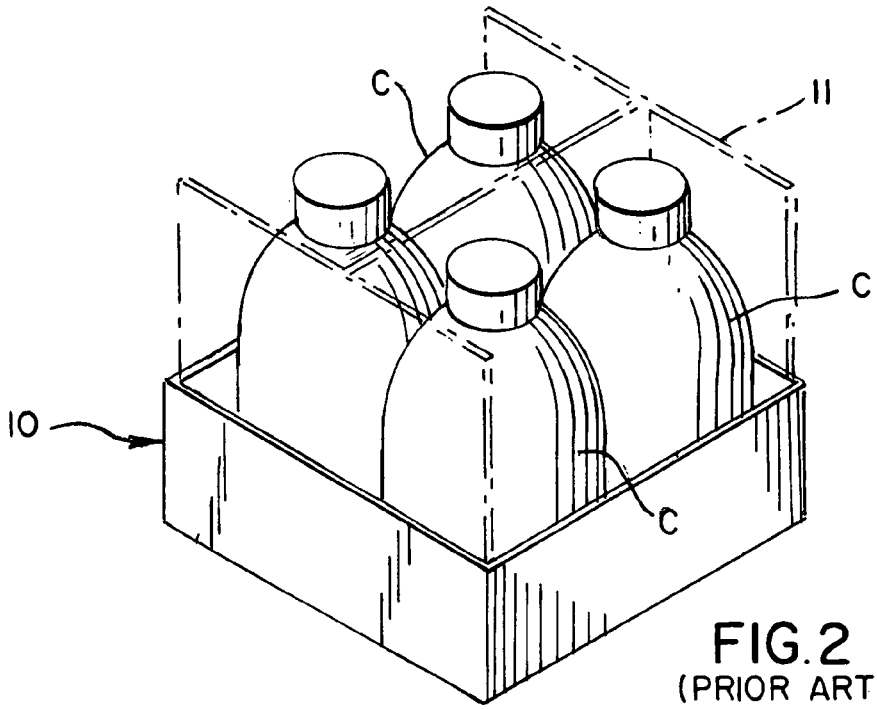
FIG. 2 (PRIOR ART)
FIG. 2 is a top perspective view of a single prior art box conventionally filled with four containers disposed in side-by-side orthogonal relationship to one another, and showing an H-shaped divider in dot-and-dash lines.
Figure 3:
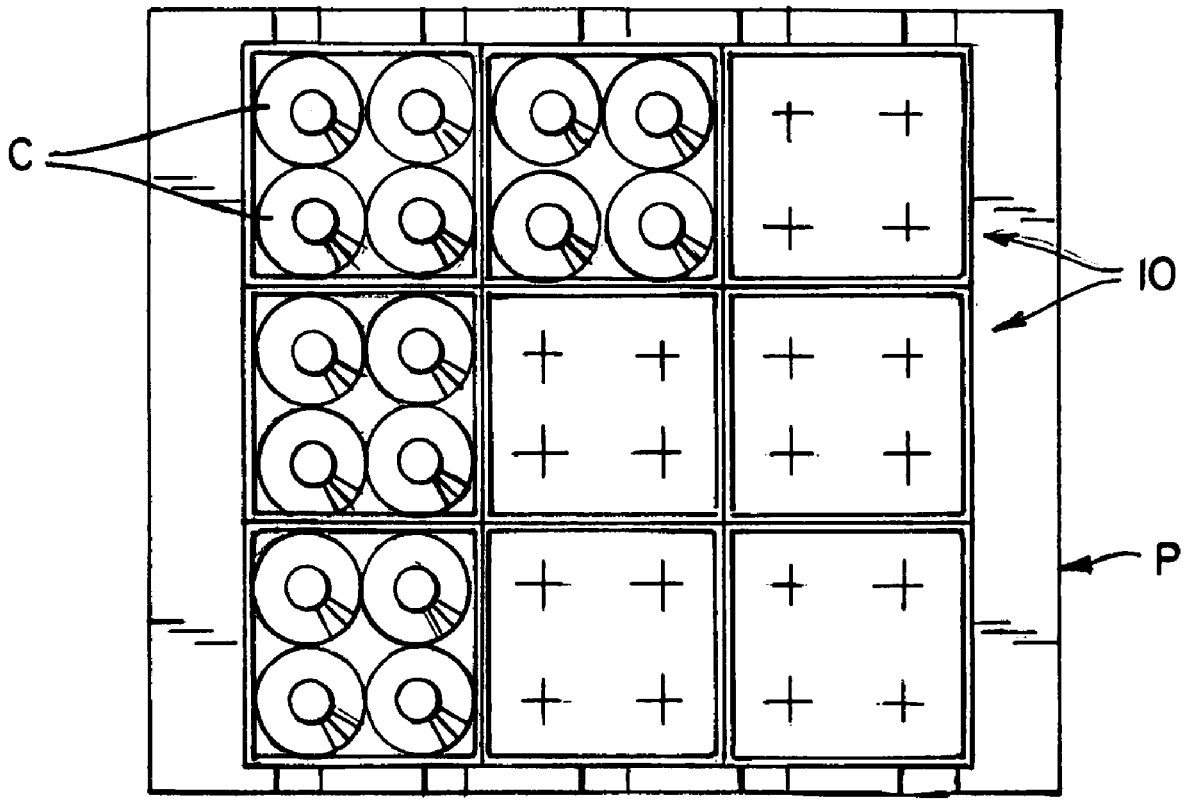
FIG. 3 (PRIOR ART)
FIG. 3 is a top plan view depicting how conventional square boxes designed for holding four one-gallon containers occupy the space on a conventional 48×40 inch pallet.

A conventional box of square shape designed for holding four one-gallon containers C is shown at 10 in FIGS. 1-3. In accordance with conventional practice, the containers are placed in the box in orthogonally disposed side-by-side relationship to one another, and an H-shaped divider 11, shown in dot-and-dash lines, is placed in the box between the containers. Boxes filled with containers are typically stacked in layers on a pallet P, and as depicted in FIGS. 1 and 2, the boxes are stacked on top of one another in columnar relationship. This arrangement is unstable, and layer sheets (not shown) are commonly placed between adjacent layers. Moreover, only nine boxes may be placed in a layer without producing pallet overhang, but this results in a substantial area of the pallet not being used.

Figure 4:
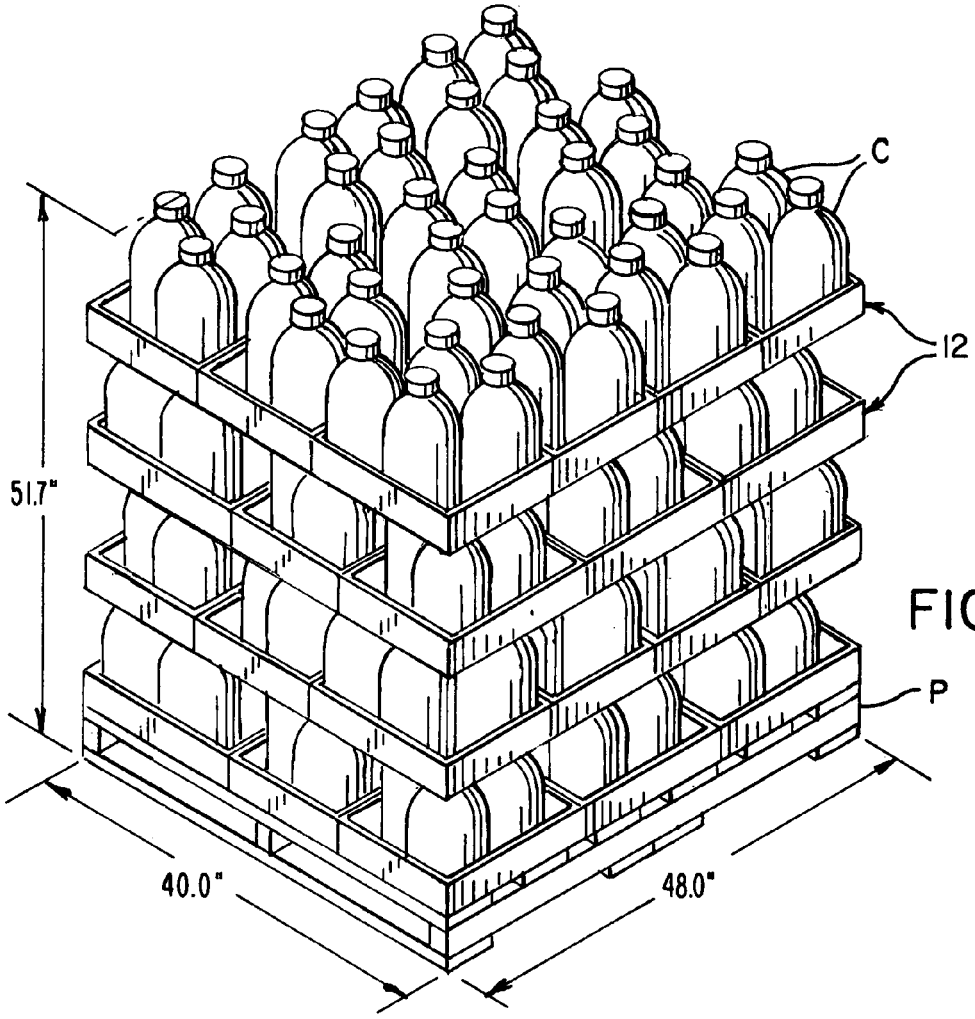
FIG. 4 is a top perspective view of rectangular boxes according to the invention filled with containers placed in offset side-by-side relationship relative to one another and cross-stacked on a pallet in interlocking relationship.
Figure 5:
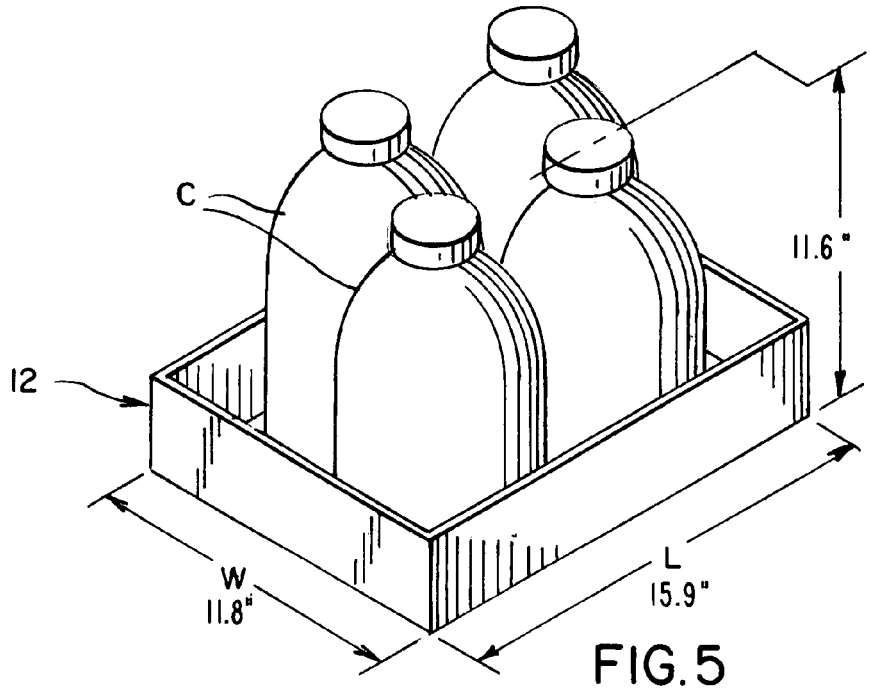
FIG. 5 is a top perspective view of a single rectangular box according to the invention filled with four containers disposed in side-by-side offset relationship to one another.
Figure 6:
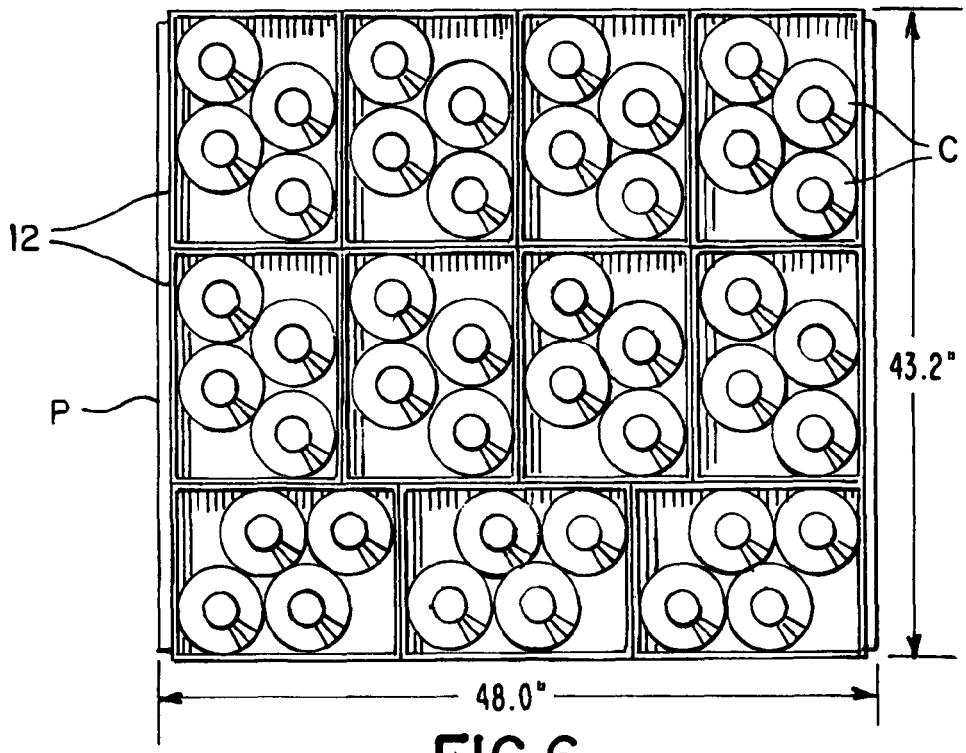
FIG. 6 is a top plan view depicting how rectangular boxes according to the invention and designed for holding four one-gallon containers occupy the space on a conventional 48×40 inch pallet.

The invention solves this problem, as depicted in FIGS. 4-7, by making the boxes 12 rectangular in shape, with a greater length dimension L than width dimension W, and placing the containers C in the box so that they are in offset or staggered relationship, as seen best in FIGS. 5 and 6. With this arrangement, the boxes may be cross-stacked in interlocking relationship to produce a stable stack without requiring the use of layer sheets. Moreover, the boxes may be arranged on the pallet P so that the footprint or area occupied by the boxes is substantially equal to the surface area of the pallet, thus enabling optimum pallet utilization.

Figure 7:
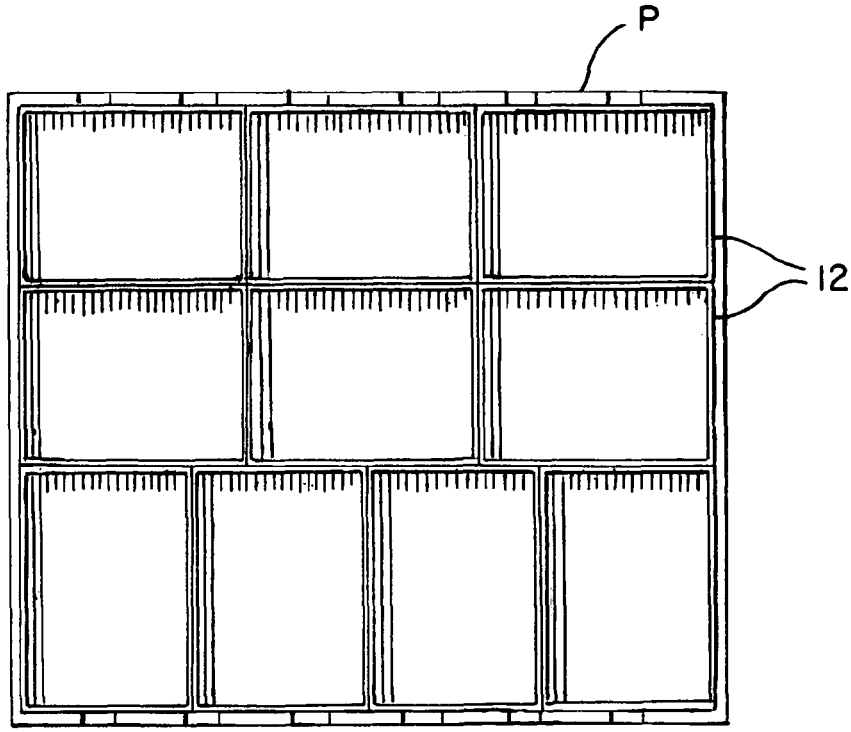
FIG. 7 is a top plan view depicting how the rectangular boxes of the invention might be alternately arranged on a pallet.

The boxes may be arranged in different ways to achieve interlocking when stacked and to maximize use of the pallet surface, as depicted for example in FIGS. 6 and 7.

A second embodiment of a box according to the invention is shown at 14 in FIGS. 8-11 and 19. The box 14 has a bottom wall 15, opposite end walls 16 and 17, opposite side walls 18 and 19, and angled interior corner panels 20 and 21 extending across the interior of the box from a respective side wall to an adjoining end wall at each of two diagonally opposite corners of the box, defining a generally parallelogram-shaped box interior, as seen best in FIG. 10.

Large openings 22 and 23 are formed in the side walls, extending from the top of the wall to an upstanding, narrow, bottom side wall segment 24 at the bottom of the opening, and offset slightly toward respective opposite ends of the box, defining a narrow first side wall end segment 25 at one end of the side wall, and a relatively wider second side wall end segment 26 at the other end of the side wall. The angled interior corner panels are foldably joined at one edge 27 to the respective second side wall end segments at the edge of the respective openings 22 and 23, and are affixed to the adjacent end wall by a glue flap 28 on the opposite free edge of the corner panel.

Figure 8:
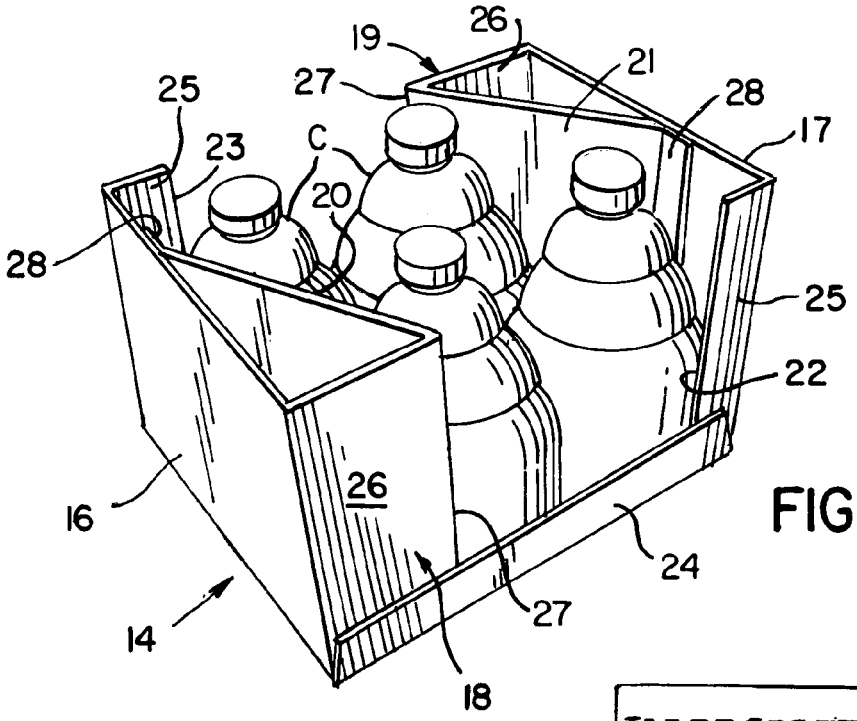
FIG. 8 is a top perspective view of a first embodiment of a box according to the invention, showing four containers of round cross-section disposed therein in offset relationship to one another, and wherein the box is made from a single unitary blank, with two side walls of substantially reduced height.

When four one-gallon containers C are placed in the box, they are oriented in nested, offset or staggered relationship as depicted in FIGS. 5, 6 and 8. The containers, and thus labels or graphics on the containers, are visible through the large openings 22 and 23, and the containers are retained in the box by the upstanding narrow bottom side wall segment 24, the angled interior corner panels 20 and 21, and the narrow first side wall end segment 25.

The interior corner panels 20 and 21 and adjacent side and end wall portions define triangular reinforcing structures at two diagonally opposite corners of the box, lending stacking strength to the box and enabling boxes filled with containers to be stacked two or more pallets high without imposing load on the containers.

Figure 9:
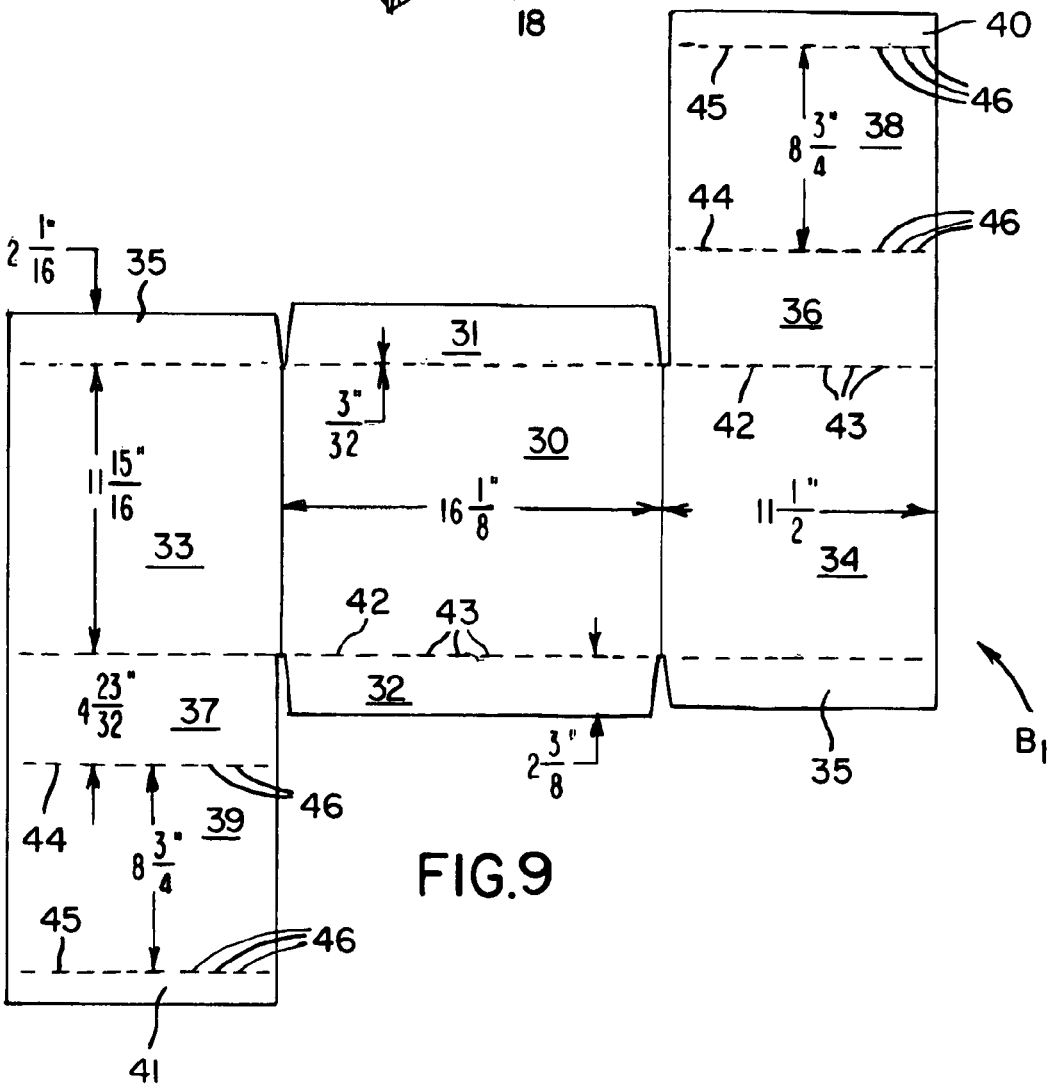
FIG. 9 is a top plan view of a blank for making the box of FIG. 8.
Figure 10:
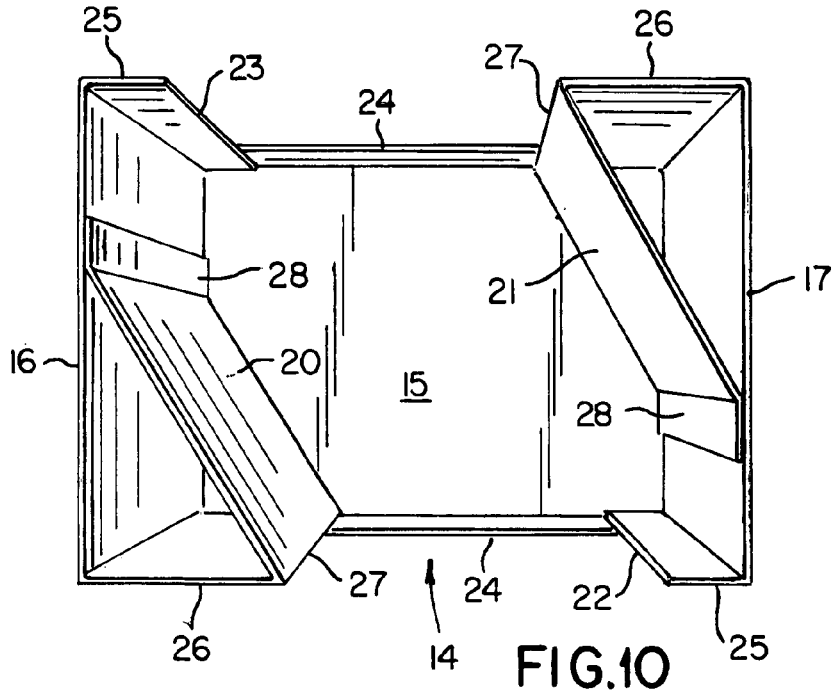
FIG. 10 is a top plan view of the box of FIG. 8.

A blank $B_1$ for forming the box of FIGS. 8 and 10 is shown in FIG. 9, and comprises a single unitary piece of corrugated board that is die-cut and scored to form an elongate, rectangular center panel 30 that forms the bottom wall 15 in the erected box. First side wall panels 31 and 32 are foldably joined to opposite side edges of the bottom-forming panel 30, and define the bottom side wall segments 24 in the erected box. End-wall-forming panels 33 and 34 are foldably joined to opposite ends of the bottom-forming panel 30, and a second side wall panel 35 is foldably joined along one edge of each panel 33 and 34 to form the narrow first side wall segments 25 in the erected box. Relatively wider third side wall panels 36 and 37 are foldably joined along one edge to the opposite side edges of the panels 33 and 34, and form the second, wider side wall segments 26 in the erected box. Corner panel-forming panels 38 and 39 of greater width than the panels 36 and 37 but narrower than panels 30-34 are foldably joined along one edge to the panels 36 and 37 and form the angled interior corner panels in the erected box. Narrow flaps 40 and 41 are foldably joined to the opposite edges of panels 38 and 39 and form the glue flaps 28. In the erected box, the glue flaps 28 are adhesively secured to an interior surface of the adjacent end wall, and the flaps 31 and 32 are folded upwardly and glued to an outer surface of the respective side end wall segments 25 and 26.

It will be noted that a continuous score 42 extends along the length of the blank at opposite sides of the bottom-wall-forming panel 30 and the end-wall-forming panels 33 and 34, and in the particular example shown, short cuts 43 are spaced along these scores. Further, in the particular example shown, the scores 44 separating the panels 36 and 38 and the panels 37 and 39, and the scores 45 separating the panels 38 and 40 and the panels 39 and 41 comprise lines of perforations 46. It should be understood, however, that the cuts and perforations need not be employed and the scores could comprise creased areas.

Figure 11:
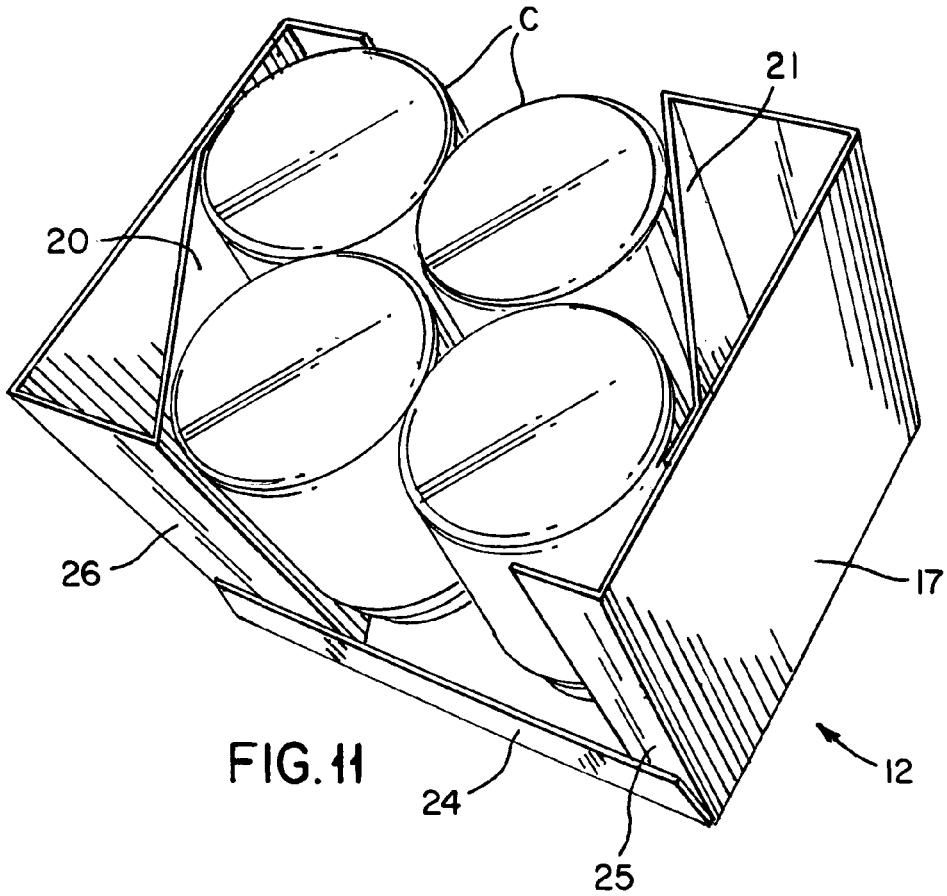
FIG. 11 is a top perspective view of the box of FIG. 8, showing four inverted containers placed therein in upside-down, offset relationship.

As indicated in FIG. 11, the containers C may be inverted and placed upside down in the box 14, where they are retained by the angled corner panels 20 and 21, the bottom side wall segment 24 and the narrow side wall segment 25. This feature enables the container manufacturer to place empty containers in the box for shipment to a facility where the containers are to be filled.

Figure 12:
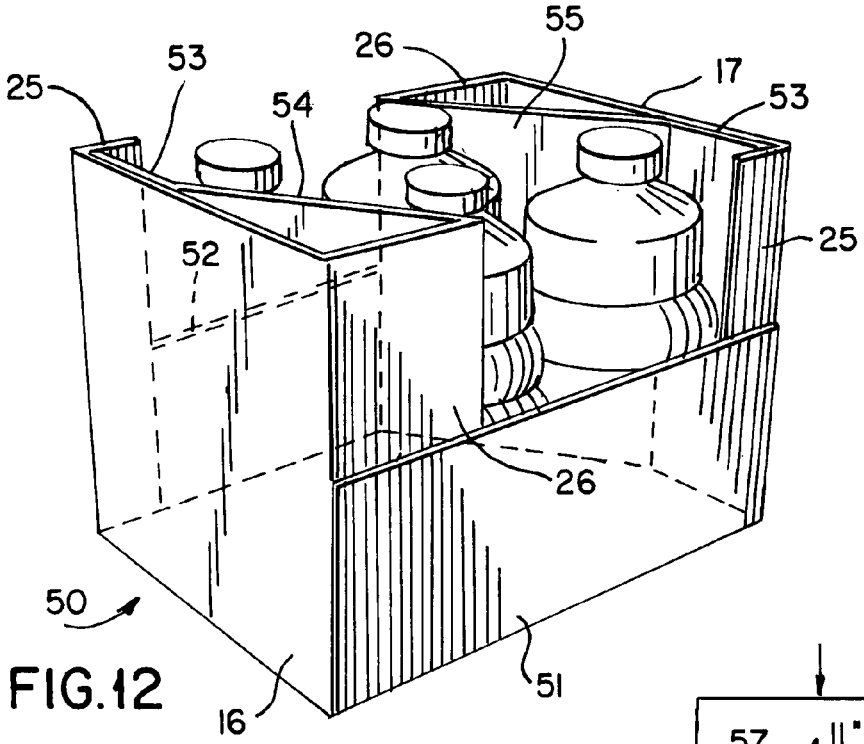
FIG. 12 is a top perspective view of a second embodiment of the box of the invention, wherein the box is constructed substantially the same as the box of FIG. 8, except that the side walls are only partially reduced in height.

A third embodiment of the box of the invention is shown at 50 in FIG. 12. This embodiment is substantially the same as the first embodiment 14 described above, except the bottom wall segments 51 and 52 are substantially wider, resulting in effectively higher side walls and a smaller opening through the side walls, and the glue flaps 53 that attach the free edge of the angled interior corner panels 54 and 55 to the adjacent end walls are wider, extending all the way into the opposite corner of the box.

Figure 13:
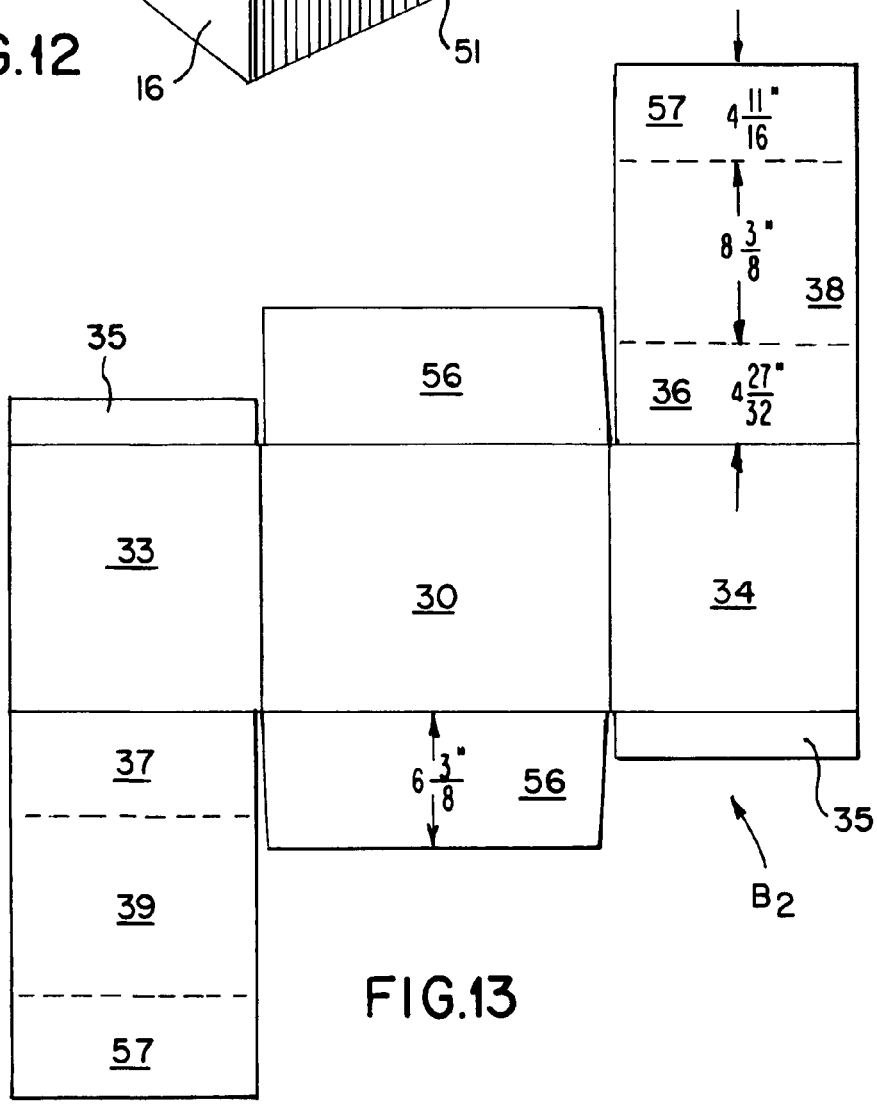
FIG. 13 is a top plan view of a blank for making the box of FIG. 12.

A blank $B_2$ for forming the box of FIG. 12 is shown in FIG. 13, and is essentially the same as the blank $B_1$ described above, except for the wider panels 56 forming the bottom side wall segments 51 and 52, and the wider panels 57 forming the corner panel glue flaps 53.

Figure 14:
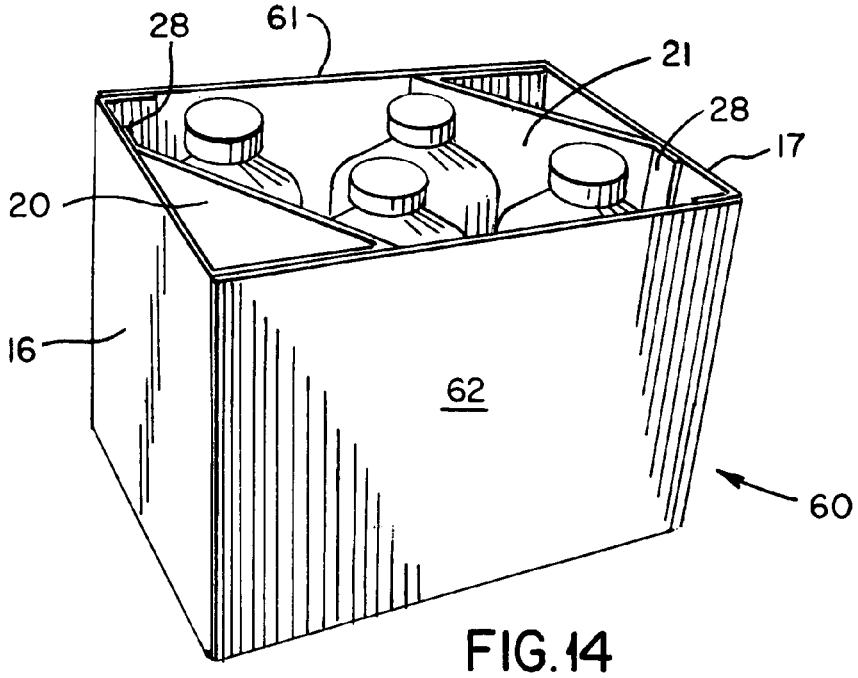
FIG. 14 is a top perspective view of a third embodiment of the box of the invention, wherein the box is constructed substantially the same as the box of FIG. 8, except that the side walls are not reduced in height.

A fourth embodiment of the box of the invention is shown at 60 in FIG. 14, and is essentially the same as the first embodiment 14 described above, except that the side walls 61 and 62 are full height, with no opening or cut-out in them.

Figure 15:
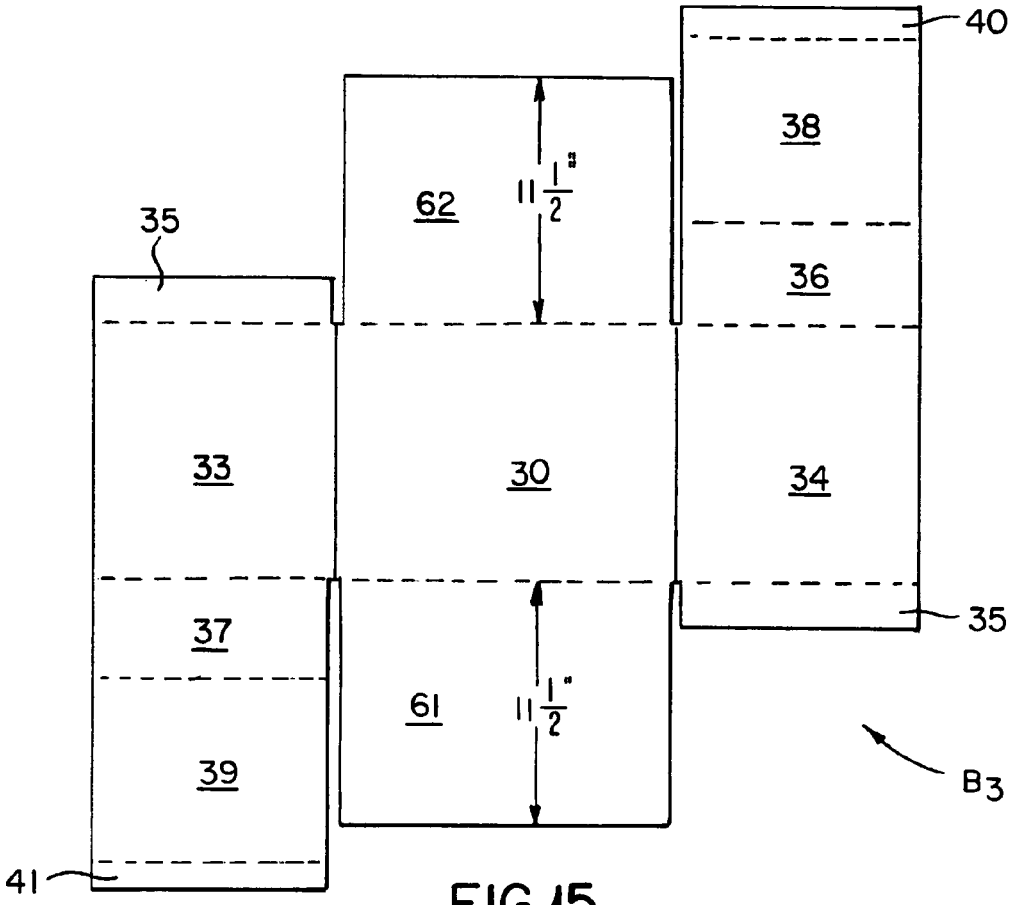
FIG. 15 is a top plan view of a blank for making the box of FIG. 14.

A blank $B_3$ for forming the box of FIG. 14 is shown in FIG. 15, and is essentially the same as the blank $B_1$ described above, except for the width of side wall panels 61 and 62, which have the same width as the height of the end walls.

Figure 16:
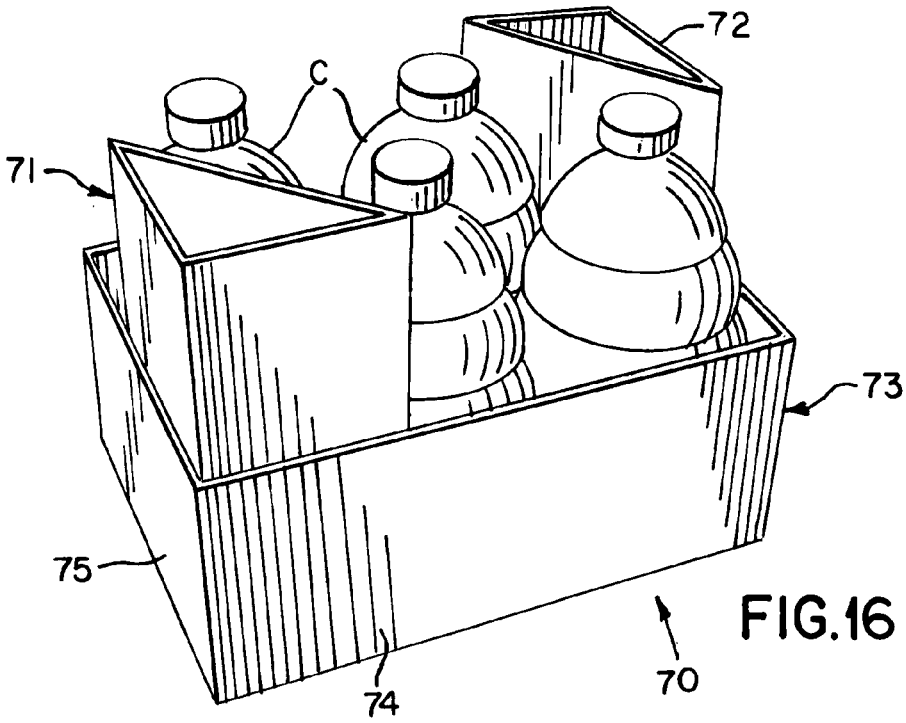
FIG. 16 is a top perspective view of a fourth embodiment of the box of the invention, wherein the box is made from one blank, the angled corner pieces comprise inserts made from additional blanks, and wherein the side walls and end walls are all of reduced height.

A fifth embodiment of the box of the invention is shown at 70 in FIG. 16. In this embodiment, separate inserts 71 and 72 of triangular cross-section are inserted into two diagonally opposite corners of a partial depth rectangular box or tray 73 similar to the box 12 shown in FIGS. 4-6. The box 73, taken alone, is of substantially conventional construction and can be used for many purposes. It has side and end walls 74 and 75 of equal height, but only about one-half the height of the containers C placed in the box. In accordance with the present invention, the inserts 71 and 72 project above the height of the side and end walls and slightly above the height of the containers.

Figure 17:
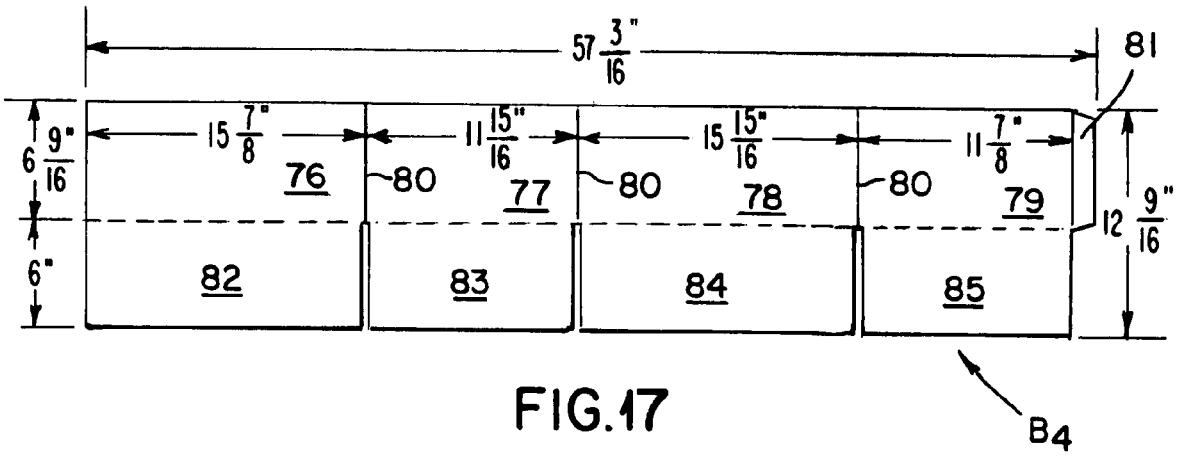
FIG. 17 is a top plan view of a blank for making the box of FIG. 16.

A blank $B_4$ for forming the box 73 is shown in FIG. 17, and comprises four rectangular panels 76, 77, 78 and 79 foldably joined together along spaced transverse score lines 80. A glue tab 81 is foldably joined to a panel 79 at one end of the blank for adhesive attachment to the panel 76 at the opposite end of the blank when the box is erected. Bottom forming flaps 82, 83, 84 and 85 are foldably connected along one edge of the respective side-wall-forming panels 76, 77, 78 and 79.

Figure 18:
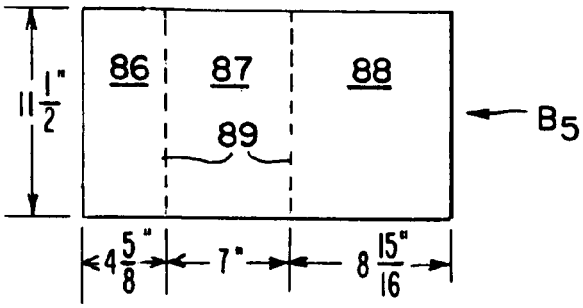
FIG. 18 is a top plan view of a blank for making the inserts used in the box of FIG. 16.

A blank $B_5$ for forming the triangular corner inserts 71 and 72 is shown in FIG. 18 and comprises first, second and third panels 86, 87 and 88 joined along scores 89.

Figure 19:
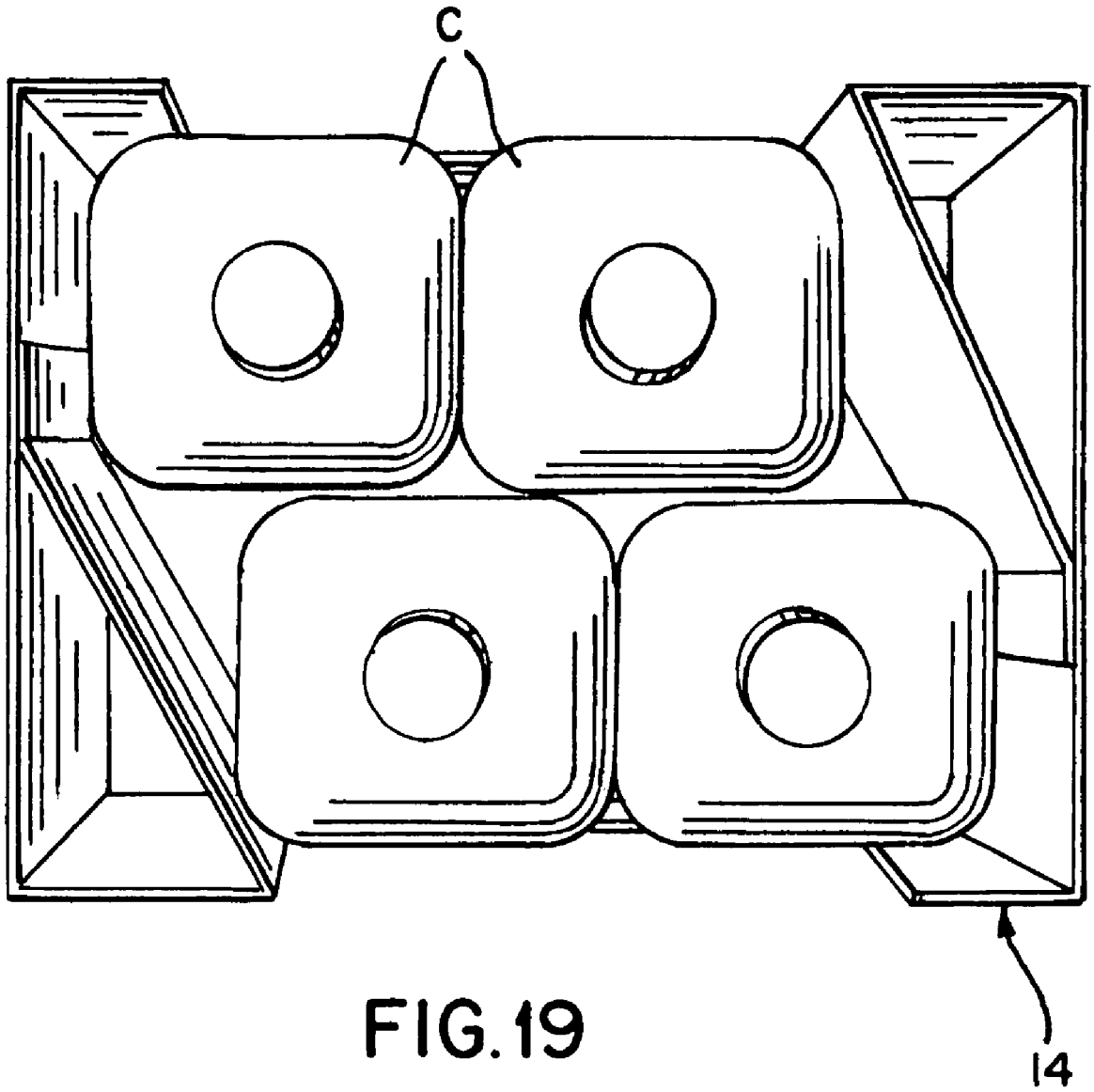
FIG. 19 is a top plan view of the box of FIG. 8, with containers having a square cross-section therein.

In FIG. 19 a plurality of containers C' of square cross-section are shown placed in the box 14 of FIGS. 8-11. This capability exists for all embodiments of the invention. This figure also clearly shows how the containers are retained in place in the box in spite of the large openings through the side walls.

Figure 20:
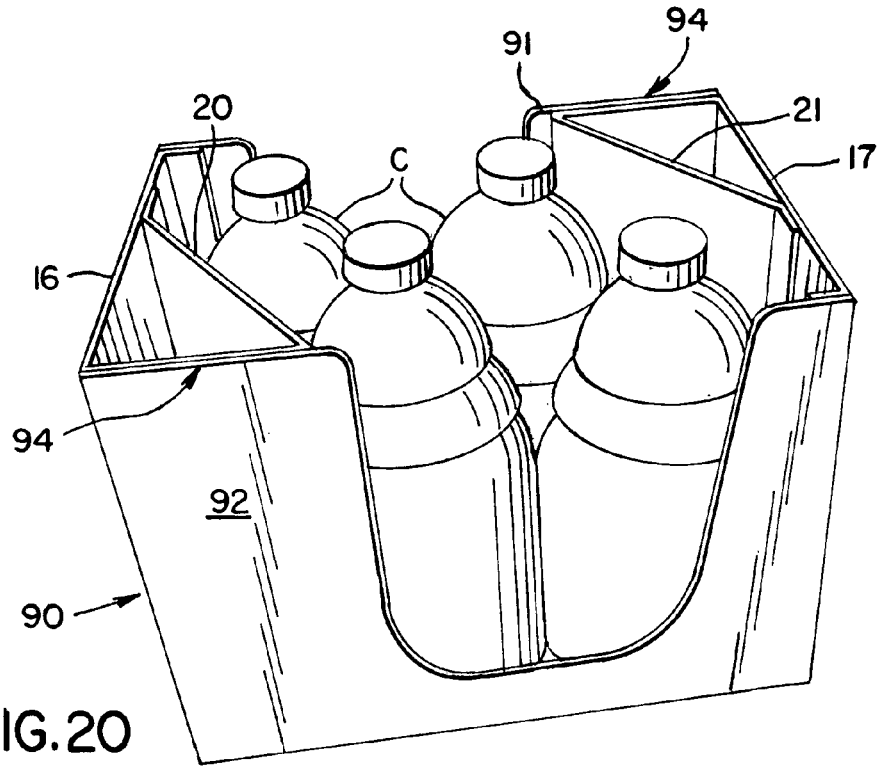
FIG. 20 is a top perspective view of a fifth embodiment of the box of the invention, wherein the reduced height side walls are defined by cut-outs in full height panels forming those side walls.

A sixth embodiment of the box of the invention is shown at 90 in FIG. 20. This embodiment is similar to the embodiment of FIG. 8, except the panels 91 and 92 foldably joined to opposite side edges of the bottom-forming panel 30 have a width to extend the full height of the box, and shaped cut-outs 93 are formed in them to provide the openings through which the containers are visible. This arrangement also produces a double thickness side wall 94 in the area between the respective angled interior corner panels 20 and 21 and the adjacent end walls.

Figure 21:
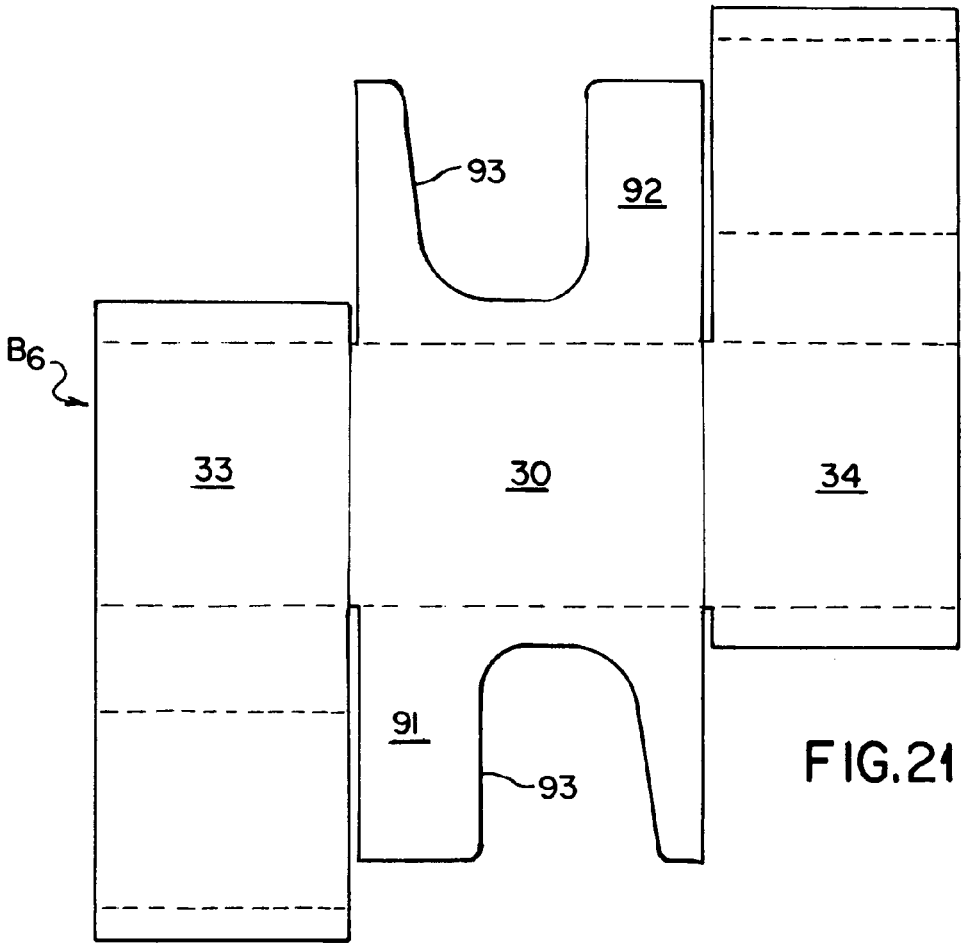
FIG. 21 is a top plan view of a blank for making the box of FIG. 20.

A blank $B_6$ for forming the box 90 is shown in FIG. 21. This blank is the same as the blank $B_1$ shown in FIG. 9, except for the panels 91 and 92 and the cut-outs 93 in these panels.

Figure 22:
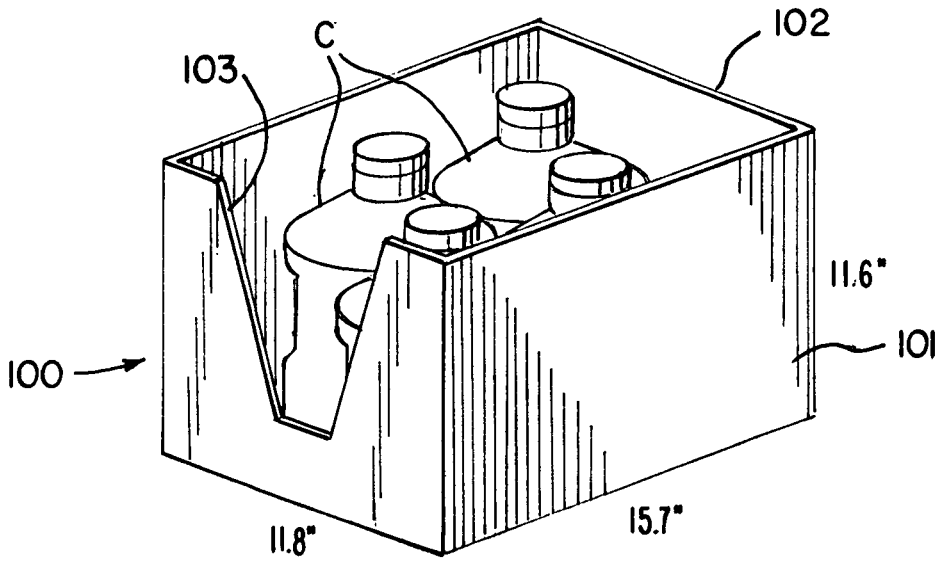
FIG. 22 is a top perspective view of an alternate embodiment of a box incorporating the invention, wherein one end wall is cut away to produce an opening through which the containers are visible.
Figure 23:
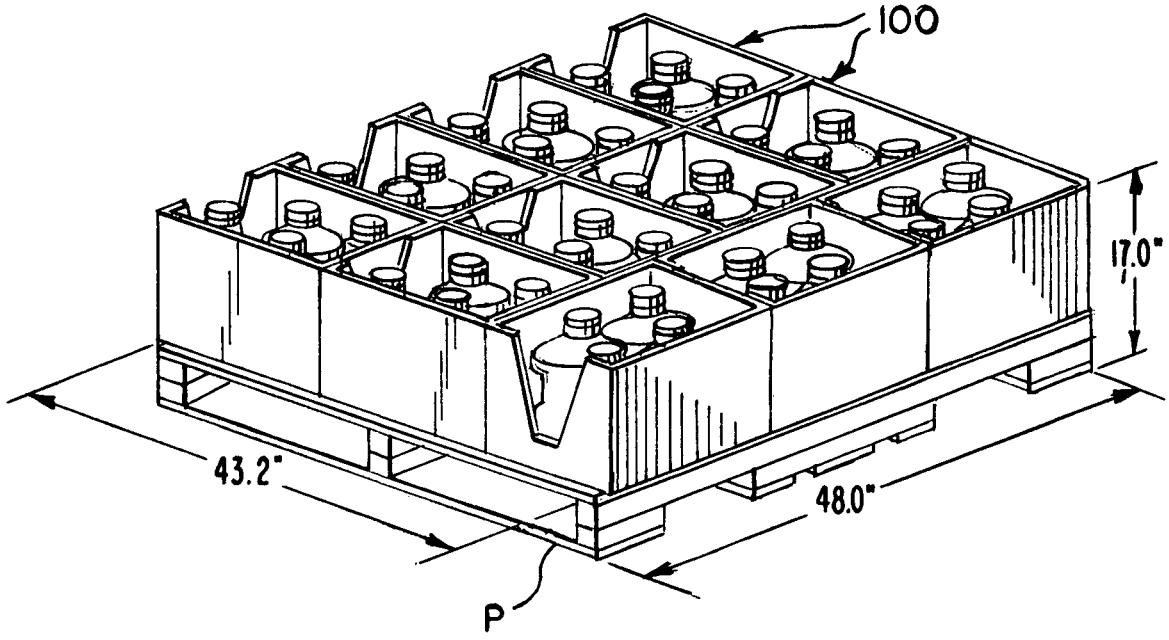
FIG. 23 is a top perspective view showing a plurality of the boxes of FIG. 22 placed on a pallet, and showing how the footprint of the area occupied by the boxes is substantially the same as the area of the pallet surface.

A seventh embodiment 100 is shown in FIGS. 22 and 23, and is similar to the embodiment shown in FIGS. 4 and 5, except in this embodiment the side walls 101 and end walls 102 have a height greater than the height of containers C placed in the box, and a cut-out 103 is formed in one end wall.

While particular embodiments of the invention have been illustrated and described in detail herein, it should be understood that various changes and modifications may be made to the invention without departing from the spirit and intent of the invention as defined by the scope of the appended claims.

What is claimed is:

1. A blank for forming an elongate, rectangular box having a bottom wall, opposite end walls, opposite side walls, and angled interior corner panels in two diagonally opposite corners, comprising:

an elongate, rectangular center panel that forms said bottom wall in an erected box;

opposite end panels foldably connected along a first edge to opposite ends of the center panel for forming said end walls in an erected box;

a first side wall panel foldably connected to each of the opposite side edges of the center panel;

a second side wall panel foldably connected to a second edge, adjacent and perpendicular to the first edge, of each of the end panels;

a third side wall panel foldably connected along a first edge thereof to a third edge, opposite the second edge, of each of the end panels and wherein said first and second side wall panels are narrow, said third side wall panels are wider than said first and second side wall panels, and said corner panel-forming panels are wider than said third side wall panels; and a corner panel-forming panel foldably connected along one edge to a second edge, opposite said first edge, of each of the third side wall panels, said corner panel-forming panel having an opposite free edge.

2. A blank as claimed in claim 1, wherein:

said first side wall panels are wider than said second and third side wall panels, and in an erected box extend approximately one-half the height of the box.

3. A blank as claimed in claim 1, wherein:

said first side wall panels are wider than said second and third side wall panels, and in an erected box extend the full height of the box.

4. A blank as claimed in claim 3, wherein:

the edge of each said first side wall panel opposite its folded connection with the center panel has a cut-out to define an opening extending over a substantial portion of the side wall in an erected box.

* * * * *